US008568031B2

(12) United States Patent
Price et al.

(10) Patent No.: US 8,568,031 B2
(45) Date of Patent: Oct. 29, 2013

(54) CLICKING CLOSURE DEVICE FOR A RECLOSABLE POUCH

(75) Inventors: William D. Price, Midland, MI (US); Richard R. Dawkins, Saginaw, MI (US)

(73) Assignee: S.C. Johnson & Son, Inc., Racine, WI (US)

( * ) Notice: Subject to any disclaimer, the term of this patent is extended or adjusted under 35 U.S.C. 154(b) by 256 days.

(21) Appl. No.: 13/031,984

(22) Filed: Feb. 22, 2011

(65) Prior Publication Data

US 2012/0213454 A1 Aug. 23, 2012

(51) Int. Cl.
*B65D 33/16* (2006.01)
*A44B 1/04* (2006.01)

(52) U.S. Cl.
USPC ..... 383/63; 383/61.2; 24/400

(58) Field of Classification Search
USPC ..... 383/63, 61.2; 24/399, 400, 585.12
See application file for complete search history.

(56) References Cited

U.S. PATENT DOCUMENTS

| | | | |
|---|---|---|---|
| 2,035,674 | A | 3/1936 | Sipe |
| 2,822,012 | A | 2/1958 | Gold |
| 3,338,284 | A | 8/1967 | Ausnit |
| 3,381,592 | A | 5/1968 | Ravel |
| 3,416,585 | A | 12/1968 | Staller |
| 3,565,147 | A | 2/1971 | Ausnit |
| RE27,174 | E | 9/1971 | Ausnit |
| 3,937,395 | A | 2/1976 | Lawes |
| RE28,969 | E | 9/1976 | Naito |
| 4,186,786 | A | 2/1980 | Kirkpatrick |
| 4,191,076 | A | 3/1980 | Bollmer et al. |
| 4,285,105 | A | 8/1981 | Kirkpatrick |
| 4,285,376 | A | 8/1981 | Ausnit |
| 4,363,345 | A | 12/1982 | Scheibner |
| 4,372,014 | A | 2/1983 | Simpson |
| 4,419,159 | A | 12/1983 | Herrington |
| 4,428,788 | A | 1/1984 | Kamp |
| 4,479,244 | A | 10/1984 | Ausnit |
| 4,484,352 | A | 11/1984 | Katzin |
| 4,515,647 | A | 5/1985 | Behr |
| 4,522,678 | A | 6/1985 | Zieke |

(Continued)

FOREIGN PATENT DOCUMENTS

| | | | |
|---|---|---|---|
| DE | 1226817 | B | 10/1966 |
| DE | 2504863 | A1 | 8/1976 |
| WO | 8600867 | A1 | 2/1986 |

OTHER PUBLICATIONS

Printout of website page "http://www.perdue.com/products/subcategory-features.html?category_id=29" on Dec. 1, 2010.
Printout of website page "http://www.daymarksafety.com/deptitem/I/P342/n/8.5_x_8.5%22_Day_of_the_Week_Bags/" on Dec. 1, 2010.
Printout of website page "http://www.daymarksafety.com/deptitem/I/P243/n/Acrylic_Portion_Bag_Dispenser/" on Dec. 1, 2010.
Printout of webstie page "http://www.glad.com.au/glad-products/food-management/glad-go-between/" on Dec. 14, 2010.

*Primary Examiner* — Jes F Pascua

(57) ABSTRACT

A reclosable pouch includes a first side wall and a second side wall joined together to form a bag. The pouch has an open top for receiving and removing items to be stored, such as food or other material. The pouch further includes at least one closure mechanism near the open top of the bag which provides for a reclosable bag. Each closure mechanism comprises a male closure element and a female closure element aligned on the opposing first and second side walls, respectively. The male closure element is asymmetrically deformed in a plurality of intermittent section. Preferably, the closure mechanism is a double zipper with at least one male section including one hook extending from an end thereof to engage the female closure element. The closure mechanism provides a clicking feel and/or sound when the pouch is closed. The closure mechanism is substantially leak-proof when closed.

21 Claims, 7 Drawing Sheets

(56) References Cited

U.S. PATENT DOCUMENTS

| | | | |
|---|---|---|---|
| 4,532,652 | A | 7/1985 | Herrington |
| 4,555,282 | A | 11/1985 | Yano |
| 4,561,108 | A | 12/1985 | Kamp |
| 4,561,109 | A | 12/1985 | Herrington |
| 4,562,027 | A | 12/1985 | Behr et al. |
| 4,578,813 | A | 3/1986 | Ausnit |
| 4,586,319 | A | 5/1986 | Ausnit |
| 4,615,045 | A | 9/1986 | Siegel |
| 4,618,383 | A | 10/1986 | Herrington |
| 4,655,862 | A | 4/1987 | Christoff et al. |
| 4,672,723 | A | 6/1987 | Hugues et al. |
| 4,673,383 | A | 6/1987 | Bentsen |
| 4,676,851 | A | 6/1987 | Scheibner et al. |
| 4,683,015 | A | 7/1987 | Wagers |
| 4,698,118 | A | 10/1987 | Takahashi |
| 4,701,358 | A | 10/1987 | Behr et al. |
| 4,709,399 | A | 11/1987 | Sanders |
| 4,709,400 | A | 11/1987 | Bruno |
| 4,710,968 | A | 12/1987 | Borchardt et al. |
| 4,736,451 | A | 4/1988 | Ausnit |
| 4,736,496 | A | 4/1988 | Fisher et al. |
| 4,741,789 | A | 5/1988 | Zieke et al. |
| 4,755,248 | A | 7/1988 | Geiger et al. |
| 4,764,977 | A | 8/1988 | Wagers |
| 4,787,880 | A | 11/1988 | Ausnit |
| 4,788,282 | A | 11/1988 | Deziel |
| 4,791,710 | A | 12/1988 | Nocek et al. |
| 4,792,240 | A | 12/1988 | Ausnit |
| 4,796,300 | A | 1/1989 | Branson |
| 4,812,056 | A | 3/1989 | Zieke |
| 4,812,192 | A | 3/1989 | Woods et al. |
| 4,822,539 | A | 4/1989 | Tilman et al. |
| 4,829,641 | A | 5/1989 | Williams |
| 4,832,768 | A | 5/1989 | Takahashi |
| 4,834,554 | A | 5/1989 | Stetler, Jr. et al. |
| 4,846,586 | A | 7/1989 | Bruno |
| 4,859,259 | A | 8/1989 | Scheibner |
| 4,869,725 | A | 9/1989 | Schneider et al. |
| 4,898,492 | A | 2/1990 | Janowski |
| 4,906,310 | A | 3/1990 | Broderick et al. |
| 4,907,321 | A | 3/1990 | Williams |
| 4,923,701 | A | 5/1990 | VanErden |
| 4,941,238 | A | 7/1990 | Clark |
| 4,964,739 | A | 10/1990 | Branson et al. |
| 5,009,828 | A | 4/1991 | McCree |
| 5,012,561 | A | 5/1991 | Porchia et al. |
| 5,017,021 | A | 5/1991 | Simonsen et al. |
| 5,022,530 | A | 6/1991 | Zieke |
| 5,023,122 | A | 6/1991 | Boeckmann et al. |
| RE33,674 | E | 8/1991 | Uramoto |
| 5,049,223 | A | 9/1991 | Dais et al. |
| 5,053,091 | A | 10/1991 | Giljam et al. |
| 5,056,933 | A | 10/1991 | Kamp |
| 5,067,822 | A | 11/1991 | Wirth et al. |
| 5,070,584 | A | 12/1991 | Dais et al. |
| 5,092,684 | A | 3/1992 | Weeks |
| 5,138,750 | A | 8/1992 | Gundlach et al. |
| 5,140,727 | A | 8/1992 | Dais et al. |
| 5,141,577 | A | 8/1992 | Porchia et al. |
| 5,154,086 | A | 10/1992 | Porchia et al. |
| 5,167,454 | A | 12/1992 | Woods et al. |
| 5,184,896 | A | 2/1993 | Hammond et al. |
| 5,186,543 | A | 2/1993 | Cochran |
| 5,192,135 | A | 3/1993 | Woods et al. |
| 5,198,055 | A | 3/1993 | Wirth et al. |
| 5,209,574 | A | 5/1993 | Tilman |
| 5,211,481 | A | 5/1993 | Tilman |
| 5,235,731 | A | 8/1993 | Anzai et al. |
| 5,238,306 | A | 8/1993 | Heintz et al. |
| 5,248,201 | A | 9/1993 | Kettner et al. |
| 5,252,281 | A | 10/1993 | Kettner et al. |
| 5,259,904 | A | 11/1993 | Ausnit |
| 5,273,511 | A | 12/1993 | Boeckman |
| 5,307,552 | A | 5/1994 | Dais et al. |
| 5,326,176 | A | 7/1994 | Domke |
| 5,345,659 | A | 9/1994 | Allan |
| 5,356,222 | A | 10/1994 | Kettner et al. |
| 5,358,334 | A | 10/1994 | Simonsen |
| 5,366,294 | A | 11/1994 | Wirth et al. |
| 5,368,394 | A | 11/1994 | Scott et al. |
| 5,369,847 | A | 12/1994 | Naya et al. |
| 5,382,094 | A | 1/1995 | Ausnit |
| 5,384,942 | A | 1/1995 | Siegel |
| 5,388,910 | A | 2/1995 | Koyanagi |
| 5,397,182 | A | 3/1995 | Gaible et al. |
| 5,403,094 | A | 4/1995 | Tomic |
| 5,405,561 | A | 4/1995 | Dais et al. |
| 5,415,904 | A | 5/1995 | Takubo et al. |
| 5,462,360 | A | 10/1995 | Tilman et al. |
| 5,474,382 | A | 12/1995 | May |
| 5,478,228 | A | 12/1995 | Dais et al. |
| 5,492,705 | A | 2/1996 | Porchia et al. |
| 5,509,734 | A | 4/1996 | Ausnit |
| 5,511,884 | A | 4/1996 | Bruno et al. |
| 5,525,363 | A | 6/1996 | Herber et al. |
| 5,527,112 | A | 6/1996 | Dais et al. |
| 5,540,500 | A | 7/1996 | Tanaka |
| 5,558,493 | A | 9/1996 | Hayashi et al. |
| 5,564,834 | A | 10/1996 | Porchia et al. |
| 5,575,747 | A | 11/1996 | Dais et al. |
| 5,577,305 | A | 11/1996 | Johnson |
| 5,588,187 | A | 12/1996 | Swain |
| 5,611,627 | A | 3/1997 | Belias et al. |
| 5,618,111 | A | 4/1997 | Porchia et al. |
| 5,647,100 | A | 7/1997 | Porchia et al. |
| 5,655,273 | A | 8/1997 | Tomic et al. |
| 5,660,479 | A | 8/1997 | May et al. |
| 5,664,299 | A | 9/1997 | Porchia et al. |
| 5,669,715 | A | 9/1997 | Dobreski et al. |
| 5,672,009 | A | 9/1997 | Malin |
| 5,686,126 | A | 11/1997 | Noel et al. |
| 5,689,866 | A | 11/1997 | Kasai et al. |
| 5,704,670 | A | 1/1998 | Surplus |
| 5,711,609 | A | 1/1998 | Simonsen |
| 5,713,669 | A | 2/1998 | Thomas et al. |
| 5,718,024 | A | 2/1998 | Robbins |
| 5,720,557 | A | 2/1998 | Simonsen |
| 5,722,128 | A | 3/1998 | Toney et al. |
| 5,729,876 | A | 3/1998 | Johnson |
| 5,747,126 | A | 5/1998 | Van Erden et al. |
| 5,749,658 | A | 5/1998 | Kettner |
| 5,769,772 | A | 6/1998 | Wiley |
| 5,774,955 | A | 7/1998 | Borchardt et al. |
| 5,775,812 | A | 7/1998 | St. Phillips et al. |
| 5,783,012 | A | 7/1998 | Porchia et al. |
| 5,791,783 | A | 8/1998 | Porchia et al. |
| 5,794,315 | A | 8/1998 | Crabtree et al. |
| 5,804,265 | A | 9/1998 | Saad et al. |
| 5,809,621 | A | 9/1998 | McCree et al. |
| 5,817,380 | A | 10/1998 | Tanaka |
| 5,827,163 | A | 10/1998 | Kettner |
| 5,832,145 | A | 11/1998 | Dais et al. |
| 5,832,570 | A | 11/1998 | Thorpe et al. |
| 5,836,056 | A | 11/1998 | Porchia et al. |
| 5,839,831 | A | 11/1998 | Mazzocchi |
| D406,685 | S | 3/1999 | McGinnis |
| 5,878,468 | A | 3/1999 | Tomic et al. |
| 5,902,046 | A | 5/1999 | Shibata |
| 5,911,508 | A | 6/1999 | Dobreski et al. |
| 5,927,855 | A | 7/1999 | Tomic et al. |
| 5,930,877 | A | 8/1999 | Thorpe et al. |
| 5,933,927 | A | 8/1999 | Miller et al. |
| 5,934,806 | A | 8/1999 | Tomic et al. |
| 5,950,285 | A | 9/1999 | Porchia et al. |
| 5,953,796 | A | 9/1999 | McMahon et al. |
| 5,955,160 | A | 9/1999 | Tanaka et al. |
| 5,964,532 | A | 10/1999 | St. Phillips et al. |
| 5,967,663 | A | 10/1999 | Vaquero et al. |
| 5,988,880 | A | 11/1999 | Tomic |
| 6,009,603 | A | 1/2000 | Gallagher |
| 6,010,244 | A | 1/2000 | Dobreski et al. |
| 6,014,795 | A | 1/2000 | McMahon et al. |

(56) References Cited

U.S. PATENT DOCUMENTS

| | | | |
|---|---|---|---|
| 6,030,122 | A | 2/2000 | Ramsey et al. |
| 6,032,437 | A | 3/2000 | Bois |
| 6,050,726 | A | 4/2000 | Hoerl |
| 6,058,998 | A | 5/2000 | Kristen |
| 6,071,011 | A | 6/2000 | Thomas et al. |
| 6,074,096 | A | 6/2000 | Tilman |
| 6,077,208 | A | 6/2000 | Larkin et al. |
| 6,080,252 | A | 6/2000 | Plourde |
| 6,110,586 | A | 8/2000 | Johnson |
| 6,112,374 | A | 9/2000 | Van Erden |
| 6,135,636 | A | 10/2000 | Randall |
| 6,138,329 | A | 10/2000 | Johnson |
| 6,139,186 | A | 10/2000 | Fraser |
| 6,148,588 | A | 11/2000 | Thomas et al. |
| 6,149,302 | A | 11/2000 | Taheri |
| 6,152,600 | A | 11/2000 | Tomic |
| 6,156,363 | A | 12/2000 | Chen et al. |
| 6,164,825 | A | 12/2000 | Larkin et al. |
| 6,167,597 | B1 | 1/2001 | Malin |
| 6,170,696 | B1 | 1/2001 | Tucker et al. |
| 6,170,985 | B1 | 1/2001 | Shabram, Jr. et al. |
| 6,187,396 | B1 | 2/2001 | Moller |
| 6,210,038 | B1 | 4/2001 | Tomic |
| 6,217,215 | B1 | 4/2001 | Tomic |
| 6,217,216 | B1 | 4/2001 | Taheri |
| 6,220,754 | B1 | 4/2001 | Stiglic et al. |
| 6,221,484 | B1 | 4/2001 | Leiter |
| 6,228,484 | B1 | 5/2001 | Willert-Porada et al. |
| 6,228,485 | B1 | 5/2001 | Leiter |
| 6,231,236 | B1 | 5/2001 | Tilman |
| 6,257,763 | B1 | 7/2001 | Stolmeier et al. |
| 6,279,298 | B1 | 8/2001 | Thomas et al. |
| 6,286,681 | B1 | 9/2001 | Wilfong, Jr. et al. |
| 6,286,999 | B1 | 9/2001 | Cappel et al. |
| 6,293,701 | B1 | 9/2001 | Tomic |
| 6,299,353 | B1 | 10/2001 | Piechocki et al. |
| 6,318,894 | B1 | 11/2001 | Derenthal |
| 6,321,423 | B1 | 11/2001 | Johnson |
| 6,360,513 | B1 | 3/2002 | Strand et al. |
| 6,371,643 | B2 | 4/2002 | Saad et al. |
| 6,386,762 | B1 | 5/2002 | Randall et al. |
| 6,394,652 | B2 | 5/2002 | Meyer et al. |
| 6,398,411 | B2 | 6/2002 | Metzger |
| 6,443,617 | B2 | 9/2002 | Tetenborg |
| 6,461,042 | B1 | 10/2002 | Tomic et al. |
| 6,461,043 | B1 | 10/2002 | Healy et al. |
| 6,481,890 | B1 | 11/2002 | VandenHeuvel |
| 6,487,758 | B2 | 12/2002 | Shaffer et al. |
| 6,491,433 | B2 | 12/2002 | Shabram, Jr. et al. |
| 6,539,594 | B1 | 4/2003 | Kasai et al. |
| 6,550,965 | B2 | 4/2003 | Shaffer et al. |
| 6,550,966 | B1 | 4/2003 | Saad et al. |
| 6,553,740 | B2 | 4/2003 | Delisle |
| 6,571,430 | B1 | 6/2003 | Savicki et al. |
| 6,574,939 | B1 | 6/2003 | Heijnen et al. |
| 6,581,249 | B1 | 6/2003 | Savicki et al. |
| 6,582,122 | B2 | 6/2003 | Shimizu |
| 6,592,260 | B1 | 7/2003 | Randall et al. |
| 6,594,872 | B2 | 7/2003 | Cisek |
| 6,637,937 | B2 | 10/2003 | Bois |
| 6,637,939 | B2 | 10/2003 | Huffer |
| 6,686,005 | B2 | 2/2004 | White et al. |
| 6,691,383 | B2 | 2/2004 | Linton |
| 6,692,147 | B2 | 2/2004 | Nelson |
| 6,703,046 | B2 | 3/2004 | Fitzhugh et al. |
| 6,712,509 | B2 | 3/2004 | Cappel |
| 6,786,712 | B2 | 9/2004 | Cisek |
| 6,789,946 | B2 | 9/2004 | Plourde et al. |
| 6,854,886 | B2 | 2/2005 | Piechocki et al. |
| 6,874,938 | B2 | 4/2005 | Price et al. |
| 6,877,898 | B2 | 4/2005 | Berich et al. |
| 6,953,542 | B2 | 10/2005 | Cisek |
| 6,954,969 | B1 | 10/2005 | Sprehe |
| 6,955,465 | B2 | 10/2005 | Machacek et al. |
| 6,962,439 | B2 | 11/2005 | Taheri |
| 6,994,535 | B2 | 2/2006 | Pawloski |
| 7,004,632 | B2 | 2/2006 | Hamilton et al. |
| 7,017,240 | B2 | 3/2006 | Savicki |
| 7,036,988 | B2 | 5/2006 | Olechowski |
| 7,087,130 | B2 | 8/2006 | Wu et al. |
| 7,137,736 | B2 | 11/2006 | Pawloski et al. |
| 7,163,706 | B2 | 1/2007 | Shepard et al. |
| RE39,505 | E | 3/2007 | Thomas et al. |
| 7,234,865 | B2 | 6/2007 | Piechocki |
| 7,241,046 | B2 | 7/2007 | Piechocki et al. |
| 7,260,871 | B2 | 8/2007 | Borchardt et al. |
| 7,270,479 | B2 | 9/2007 | Nelson |
| 7,305,742 | B2 | 12/2007 | Anderson |
| 7,322,747 | B2 | 1/2008 | Borchardt |
| 7,334,682 | B2 | 2/2008 | Goepfert |
| 7,347,624 | B2 | 3/2008 | Savicki, Sr. et al. |
| RE40,284 | E | 5/2008 | Thomas et al. |
| 7,410,298 | B2 | 8/2008 | Pawloski |
| 7,437,805 | B2 | 10/2008 | Berich |
| 7,517,484 | B2 | 4/2009 | Wu |
| 7,534,039 | B2 | 5/2009 | Wu |
| 7,543,361 | B2 | 6/2009 | Borchardt et al. |
| 7,553,082 | B2 | 6/2009 | Yoder |
| 7,585,111 | B2 | 9/2009 | Turvey et al. |
| 7,651,271 | B2 | 1/2010 | Withers |
| 7,674,039 | B2 | 3/2010 | McMahon et al. |
| 7,674,040 | B2 | 3/2010 | Dowd et al. |
| 7,736,058 | B2 | 6/2010 | Tanaka et al. |
| 2002/0064582 | A1 | 5/2002 | Carabetta et al. |
| 2002/0090151 | A1 | 7/2002 | Skeens et al. |
| 2002/0153273 | A1 | 10/2002 | Mallik et al. |
| 2002/0173414 | A1 | 11/2002 | Leighton |
| 2003/0169948 | A1 | 9/2003 | Fenzl et al. |
| 2003/0177619 | A1 | 9/2003 | Cisek |
| 2003/0210836 | A1 | 11/2003 | Strand |
| 2003/0223654 | A1 | 12/2003 | Gerrits |
| 2003/0223657 | A1 | 12/2003 | Belias et al. |
| 2003/0232112 | A1 | 12/2003 | Whitmore et al. |
| 2004/0001651 | A1 | 1/2004 | Pawloski |
| 2004/0078939 | A1 | 4/2004 | Pawloski |
| 2004/0078940 | A1 | 4/2004 | Ishizaki |
| 2004/0131283 | A1 | 7/2004 | Sprague et al. |
| 2004/0234171 | A1 | 11/2004 | Dais et al. |
| 2004/0234173 | A1 | 11/2004 | Saad et al. |
| 2004/0256761 | A1 | 12/2004 | Pawloski |
| 2005/0034427 | A1 | 2/2005 | Higer et al. |
| 2005/0063616 | A1 | 3/2005 | Chang |
| 2005/0141786 | A1 | 6/2005 | Piechocki et al. |
| 2005/0207679 | A1 | 9/2005 | Armstrong |
| 2005/0271308 | A1 | 12/2005 | Pawloski |
| 2005/0276524 | A1 | 12/2005 | Taheri |
| 2005/0281921 | A1 | 12/2005 | Langston et al. |
| 2005/0286810 | A1 | 12/2005 | Sprague et al. |
| 2005/0286811 | A1 | 12/2005 | Sprague et al. |
| 2005/0286812 | A1 | 12/2005 | Sprague et al. |
| 2006/0008187 | A1 | 1/2006 | Armstrong |
| 2006/0078232 | A1 | 4/2006 | Trinko |
| 2006/0165316 | A1 | 7/2006 | Cheung |
| 2006/0257533 | A1 | 11/2006 | Plourde et al. |
| 2007/0155607 | A1 | 7/2007 | Bassett et al. |
| 2007/0183692 | A1 | 8/2007 | Pawloski |
| 2007/0206888 | A1 | 9/2007 | Chang |
| 2008/0137995 | A1 | 6/2008 | Fraser et al. |
| 2008/0159662 | A1 | 7/2008 | Dowd et al. |
| 2008/0226202 | A1 | 9/2008 | Dais et al. |
| 2008/0226203 | A1 | 9/2008 | Dais et al. |
| 2008/0232722 | A1 | 9/2008 | Pawloski et al. |
| 2008/0285897 | A1 | 11/2008 | Taheri |
| 2008/0292222 | A1 | 11/2008 | Snoreck |
| 2009/0034885 | A1 | 2/2009 | McGruder |

(56) References Cited

U.S. PATENT DOCUMENTS

| | | | |
|---|---|---|---|
| 2009/0052809 | A1 | 2/2009 | Sampson |
| 2009/0097781 | A1 | 4/2009 | Tang |
| 2009/0190860 | A1 | 7/2009 | Kettner et al. |
| 2009/0214141 | A1 | 8/2009 | Borchardt et al. |
| 2009/0232421 | A1 | 9/2009 | Turvey |
| 2009/0257685 | A1 | 10/2009 | Matias |
| 2009/0304311 | A1 | 12/2009 | Noguchi et al. |
| 2010/0014786 | A1 | 1/2010 | Pawloski et al. |
| 2010/0166341 | A1 | 7/2010 | McMahon et al. |

CLICKING CLOSURE DEVICE FOR A RECLOSABLE POUCH

FIELD OF INVENTION

The present technology relates to closures for reclosable pouches. More specifically, the present technology is directed to a closure mechanism having a female closure element and a male closure element wherein at least one of the female and male closure element has asymmetric deformations such that upon engagement a clicking sound and/or clicking tactile response is generated more significantly from one side of the closure mechanism than the other side.

BACKGROUND OF THE INVENTION

Storage bags are well-known in the art. For example, ZIPLOC® brand bags provide a very good and useful reclosable storage bag for storing food or other material. Most storage bags include a first side panel and a second side panel which side panels are sealed at the edges and bottom forming the bag having an open top. These bags include reclosable closure mechanisms near the top portion or lips of the bag for opening and closing the bag. For example, U.S. Pat. No. 7,410,298 ("the '298 patent") assigned to S. C. Johnson Home Storage Inc., the assignee herein, discloses closure mechanisms for reclosable pouches.

The '298 patent discloses a disposable pouch having side walls. The pouch includes first and second closure mechanisms also known as a double zipper. The first closure mechanism on the lip side comprises a first male closure element and a first female closure element, both of which are substantially symmetrical about a transverse centerline. The first male closure element includes an engagement number having two hook portions that extend from a base. The first female closure element includes a base with a first spaced leg and a second spaced leg extending therefrom. The first female closure element is adapted to receive the first male element when pressure is exerted on the closure elements by the user's fingers during closing of the bag.

The second closure mechanism on the bag side of the double zipper in the '298 patent includes a second male closure element and a second female closure element. The second female closure element is substantially the same as the first female closure element. However, the second male closure element includes an engagement member comprising a single hook portion that extends from a base. The second male closure element is substantially asymmetrical about a longitudinal centerline. The closure mechanisms are formed by extrusion.

The first closure mechanism of the '298 patent exhibits a clicking feel and sound when the bag is opened or closed. Such a clicking feel and sound are created by having intermittent deformations in the first male closure element. These deformed segments are also substantially symmetrical about the transverse centerline thereof. Another example of closure mechanisms with deformed segments is U.S. Pat. No. 5,140,727 issued on Aug. 25, 1992 to Dais et al. ("the '727 patent"). The deformed portions may be formed by opposing toothed gripper wheels. Such deformation provides for the clicking sound and/or feel when opening or closing the bag. However, the deformations may not provide for a substantially leak-proof seal because of the deformations or cuts may remove or damage the sealing surfaces.

On the bag side in the '298 patent, the second male element is not deformed and does not provide for a clicking sound and/or feel. The stem of the second male element is smooth and not deformed to provide an excellent seal. In theory, a good seal is formed between second male closure element and the second female closure element by engagement of the ends of legs 260 and 262 with the stem of male member so that potential leaks from poor sealing on the lip side closure mechanism are irrelevant.

SUMMARY OF THE INVENTION

While the current storage bags closure mechanisms have been tremendously successful in the market for storing food and the like, there is room for improvement, including providing a closure mechanism having a male element which engages a female element, wherein at least one of the female and male elements are asymmetrically deformed to provide a clicking feel and/or sound more substantially from one side or even only from one side when the bag is opened and closed yet still provide a substantially leak-proof seal.

The present technology is directed to a reclosable pouch comprising a first side wall, a second side wall and a bottom portion which forms the bag with an open top portion for receiving and removing items to be stored, such as food or other material. The pouch further includes at least one closure mechanism near the open top of the bag which provides for a reclosable bag. The closure mechanism comprises a male closure element and a female closure element. The male closure element is asymmetrical and preferably includes one hook extending from an end thereof to engage the female closure element and is asymmetrically deformed to provide a clicking feel and/or sound when the pouch is closed. The male closure element in conjunction with the female closure element will provide a substantially leak-proof seal when the pouch is closed. In an alternative embodiment, the female closure element is asymmetrically deformed.

The present technology is further directed to a reclosable pouch comprising a body portion having first and second walls and first and second closure mechanisms. The first closure mechanism comprises a first male closure element and a first female closure element wherein the first male and first female closure elements are disposed on opposing sides of the first and second walls. The second closure mechanism comprises a second male closure element and a second female closure element. The second female closure element has spaced legs and wherein the second male and second female closure elements are disposed on opposing sides of the first and second bag walls. The second male closure element includes an asymmetrical structure having one hook portion extending from an end therefrom to engage the second female closure element. The second male closure element includes deformations on one side thereof to provide a clicking feel and/or sound when the pouch is closed and provides a substantially leak-proof seal.

The present technology is further directed to a reclosable pouch comprising a body portion having first and second bag walls and first and second closure mechanisms. The first closure mechanism comprises a first male closure element that is substantially symmetric about a longitudinal centerline and a first female closure element wherein the first female closure element has first and second spaced legs that are substantially symmetric along a longitudinal centerline, and wherein the first male and female closure elements are disposed on opposing sides of the first and second bag walls. The second closure mechanism comprises a second male closure element, and a second female closure element that is substantially identical to the first female element, wherein the second female closure element has third and fourth spaced legs, and wherein the second male and second female closure elements are disposed on opposing sides of the first and second bag walls. The first male closure element includes two hook portions extending from an end thereof to engage the legs of the first female closure element. The second male closure element is asymmetrical and includes one hook portion extending from an end thereof to engage the legs of the second female closure element. The second male closure element is intermittently deformed on at least one side thereof and provides for a clicking feel and/or sound when the pouch is closed. Preferably, the deformations are asymmetric. The novel second male closure element in conjunction with the second female closure element will provide a substantially leak-proof seal when the pouch is closed.

In another embodiment, the subject technology is directed to a reclosable pouch including a body portion having first and second bag walls and a closure mechanism. The closure mechanism includes an elongated male closure element having a base, a stem and an engagement end as well as a female closure element, wherein the female closure element has first and second spaced legs. The male and female closure elements are disposed on opposing sides of the first and second bag walls. The male closure element is constructed and arranged to engage the legs of the female closure element such that at least one of the male and female elements includes deformations only along one side to create at least one of a clicking feel and a clicking sound when the pouch is closed. In another embodiment, the deformations are intermittent and asymmetric. By asymmetric, it is meant that, without limitation, the deformations may be on only one side or on both sides but more substantial to better create clicking or just differently shaped on the opposing side.

The deformations of the male element may be formed by a first toothed gripper wheel and a second smooth gripper wheel being deployed in an opposing manner to form a gap. The first toothed gripper wheel and said second smooth gripper wheel are at approximately 45° angles to form the gap that the male or female closure element passes through. For the male closure element, the gap is of a distance approximately equal to a width of the stem of the male closure element. The pouch may include a second closure mechanism that also creates the clicking sound and/or feel. Preferably, only the male element is deformed and the stem of the male element is substantially unchanged on an opposing side to the deformations to maintain an effective seal The subject technology is also directed to a reclosable pouch including opposing first and second walls joined together to form an interior for storing items and a closure mechanism including a male closure element coupled to the first wall and a female closure element coupled to the second wall. The male closure element has a proximal base adjacent the first wall, a stem extending from the base, a distal end. The male closure element defines a plurality of deformations. The female closure element has first and second spaced legs that define a channel. The male closure element is sized and arranged to interlock in the channel of the female closure element such that a clicking sound is generated at least mostly or even only by the plurality of deformations along one side of the stem during sealing of the closure mechanism. Preferably, during sealing a clicking tactile cue is also generated by the plurality of deformations along the one side of the stem. The closure mechanism can include a similar or dissimilar second female and male closure elements to be a double zipper configuration, each of which may or may not click as disclosed herein. The second pair of closure elements may also even generate a sound at an audibly different frequency from the first male closure element. Third, fourth or any number of female and male pairs of closure elements may be provided to produce triple zippers, quad zippers and the so on. The male and female closure elements may be on the same bag walls, respectively, or variably placed on different walls.

Another embodiment of the subject technology is directed to a reclosable pouch including first and second opposing walls joined to form a bag, each wall having a lip that forms part of an opening for the bag, and an elongated closure mechanism attached to the walls for sealing the opening. The closure mechanism has at least one female closure element and at least one male closure element having a plurality of deformed portions intermittent normal portions. On a first side of the male closure element, the sealing surfaces are substantially unchanged from the normal to the deformed portions and gradual ramps define transitions between the normal and deformed portions. On a second side of the male closure element, transitions from the normal to the deformed portions are defined by a substantial step transition so that upon inserting the male closure element into the female closure element, the substantial step transitions create one of a clicking feel or a clicking sound.

A preferred length of the deformed portions is less than 0.15 of an inch {3.81 mm}. The male closure element includes a base and a stem extending from the base to terminate in an engagement feature. The sealing surfaces are substantially on the stem. The engagement feature has a cross-sectional shape selected from the group consisting of a hook, an arrow head, a three-lobed arrow head, a rounded stem, an asymmetrical triangle, and a symmetrical triangle. The female closure element may also define deformed portions having a relatively quiet side and a relatively loud sound producing side. The closure mechanism may be a double zipper that has a female and/or male closure elements that produce sound at a different frequency from the first closure mechanism.

The different embodiments of the present technology will be apparent from the following description of the preferred embodiments of the invention and from the accompanying drawings.

BRIEF DESCRIPTION OF THE DRAWINGS

The following detailed description of specific non-limiting embodiments of the present invention can be best understood when read in conjunction with the following drawings, where like structures are indicated with like reference numbers.

DETAILED DESCRIPTION OF THE PREFERRED EMBODIMENTS

Figure 1:
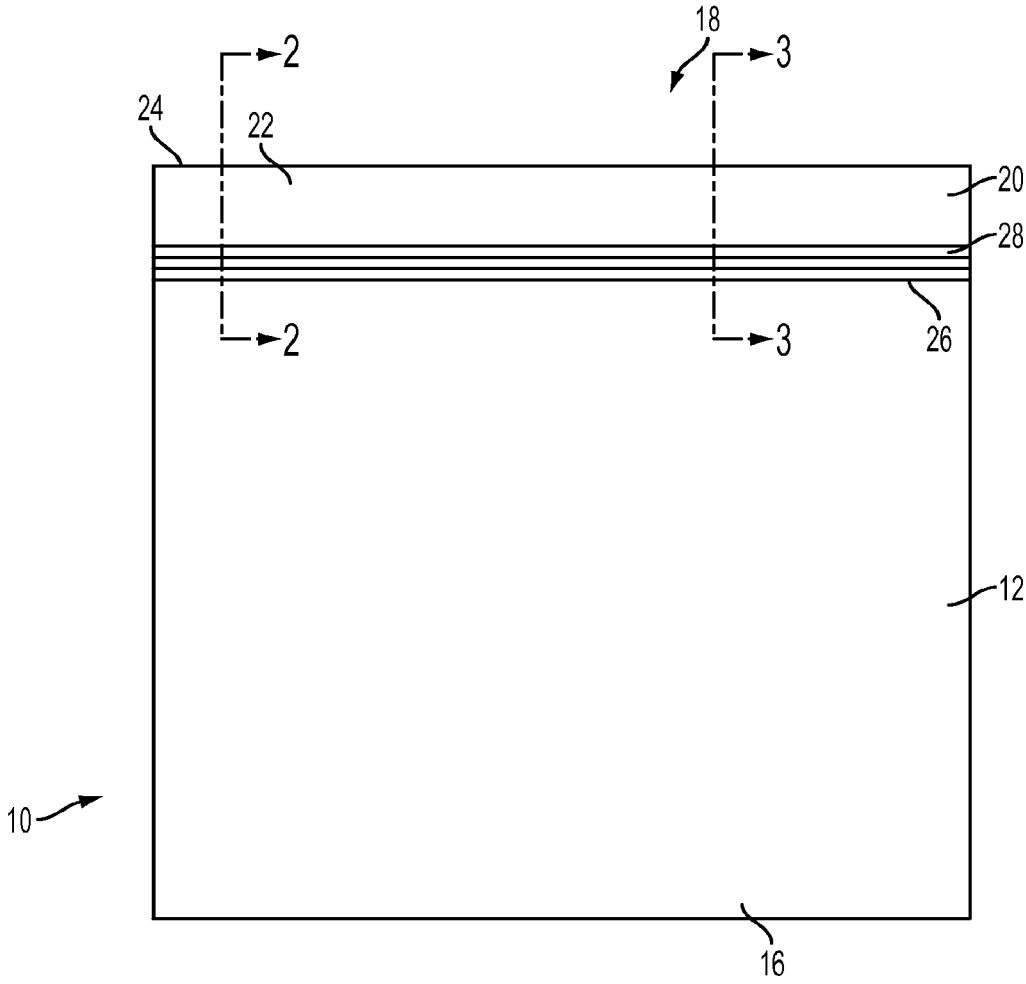
FIG. 1 is an elevational view of a reclosable thermoplastic storage bag incorporating the present technology.

The present disclosure overcomes many of the prior art problems associated with vented pouches and bags. The advantages, and other features of the technology disclosed herein, will become more readily apparent to those having ordinary skill in the art from the following detailed description of certain preferred embodiments taken in conjunction with the drawings which set forth representative embodiments of the present invention and wherein like reference numerals identify similar structural elements.

All relative descriptions herein such as left, right, up, and down are with reference to the Figures, and not meant in a limiting sense. Unless otherwise specified, the illustrated embodiments can be understood as providing exemplary features of varying detail of certain embodiments, and therefore, unless otherwise specified, features, components, modules, elements, and/or aspects of the illustrations can be otherwise resized, combined, interconnected, sequenced, separated, interchanged, positioned, and/or rearranged without materially departing from the disclosed systems or methods. The shapes and sizes of components are also exemplary and unless otherwise specified, can be altered without materially affecting or limiting the disclosed technology. Additionally, the representations shown herein may be somewhat idealized in that manufacturing processes typically have variation and approximate the features, which can be drawn with clarity beyond that which can be made.

Referring now to FIG. 1, a perspective view of a reclosable pouch 10 with a double zipper closure mechanism in accordance with the subject technology is shown. The pouch 10 is preferred by users because the double zipper has a clicking feel and sound during opening and closing to provide assurance of proper closure.

The reclosable pouch or thermoplastic storage bag 10 comprises a first side wall 12, a second side wall 14 and a bottom portion 16 which when sealed forms bag 10 having an opening 18. Bag 10 includes a top portion 20 having two lips 22 disposed at top portion 20 and an upper edge 24. First and second closure mechanisms 26 and 28 are disposed at the top portion 20 of the bag 10. The first closure mechanism 26 is on the bag side and the second closure mechanism 28 is on the lip side. The bag 10 may be made of one or more plastic materials such as polypropylene, polyethylene, bioplastics and mixtures thereof.

The thermoplastic storage bag 10 of the present technology may include other features and attributes such as disclosed in previously referenced U.S. Pat. No. 7,410,298. Other configurations and additional features are also possible without limitation such as shown in U.S. Pat. No. 5,070,584 issued to Dais et al. on Dec. 10, 1991, U.S. Pat. No. 6,692,147 issued to Nelson on Feb. 17, 2004, U.S. Pat. No. 6,962,439 issued to Taheri on Nov. 8, 2005, U.S. Pat. No. 6,010,244 issued to Dobreski et al. on Jan. 4, 2000, U.S. Pat. No. 7,736,058 issued to Tanaka et al. on Jun. 15, 2010, U.S. Pat. No. 7,322,747 issued to Borchardt on Jan. 29, 2008, and U.S. Pat. No. 7,674,039 issued to McMahon et al. on Mar. 9, 2010 as well as U.S. Patent Application Pub. No. 2004/0234171 to Dais et al. published on Nov. 25, 2004, U.S. Patent Application Pub. No. 2004/0234173 to Saad et al. published on Nov. 25, 2004, U.S. Patent Application Pub. No. 2007/0183692 to Pawloski published on Aug. 9, 2007, and U.S. Patent Application Pub. No. 2006/0008187 to Armstrong published on Jan. 12, 2006.

Figure 3:
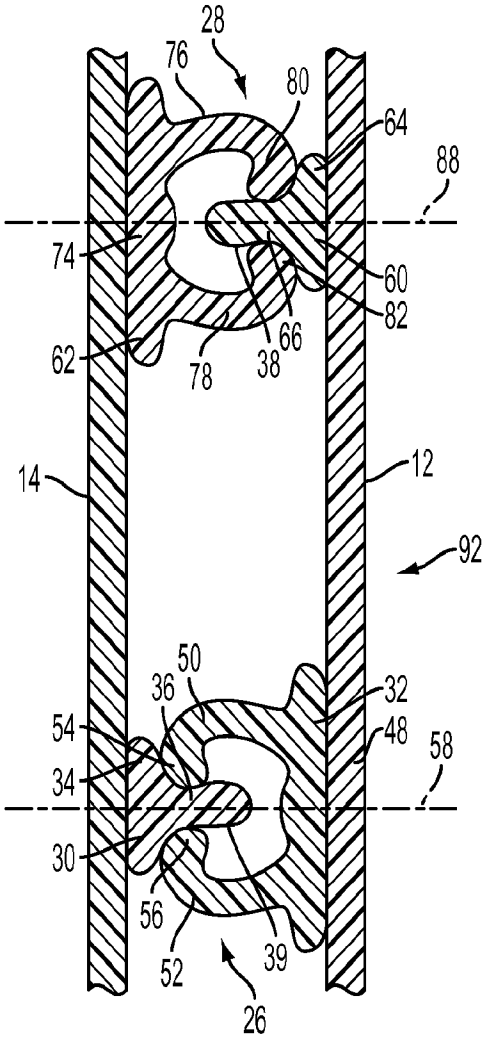
FIG. 3 is an enlarged, fragmentary, sectional view taken generally along lines 3-3 of FIG. 1 through a deformed segment.
Figure 2:
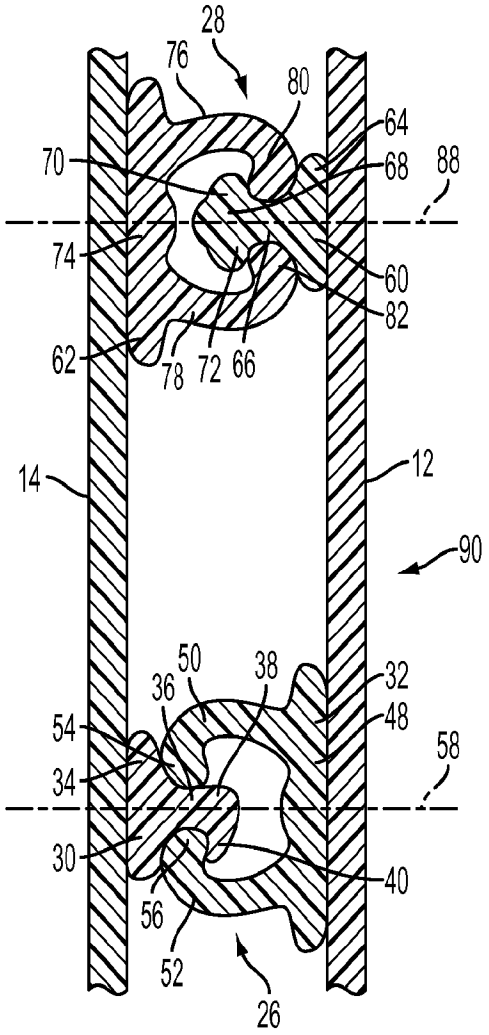
FIG. 2 is an enlarged, fragmentary, sectional view taken generally along lines 2-2 of FIG. 1 through a normal segment.

Referring now to FIG. 2, an enlarged, fragmentary, sectional view taken generally along lines 2-2 of FIG. 1 through a normal segment 90 is shown. The closure mechanisms 26 and 28 are secured to the side walls 12 and 14. The closure mechanisms 26 and 28 are characterized by intermittent and preferably alternating first and second segments 90 and 92. The first segment 90, illustrated in FIG. 2, is referred to as normal in that the cross-section remains unchanged from the extrusion formation process. However, the second segment 92, illustrated in FIG. 3, is referred to as deformed because the second segment 92 is modified during the forming process by deformer wheels as discussed hereinbelow.

The Normal Segments

Still referring to FIG. 2, closure mechanism 26 illustrates a preferred embodiment of the present technology and will be described in detail hereafter. Closure mechanism 26 includes a male closure element 30 and a female closure element 32. The male closure element 30 and female closure element 32 are in alignment when closed as shown and somewhat still aligned albeit separated when the bag 10 is open.

The female closure element 32 comprises a base portion 48 and spaced legs 50 and 52 having hooked end portions 54 and 56. Female element 32 is generally C shaped. The female element 32 is symmetrical about a longitudinal centerline 58.

Male closure element 30 comprises a base portion 34, a stem portion 36 and engaging portion 38 having a hook 40 facing the bag side. By having the hook 40, greater force will be required to open the bag 10 from within or by pulling on the walls 12 and 14 from the bag side as compared to the opening force required when utilizing the lips 20. However, effective sealing will occur between the hooked end portions 54 and 56 of the female closure element 32 and stem portion 36 of the male closure element 30. The engaging portion 38 of the male closure element 30 may also have a lateral member opposing the hook, e.g., facing the lip side.

Still referring to FIG. 2, closure mechanism 28 may be as disclosed in U.S. Pat. No. 7,410,298 as described above in the normal segments 90. More particularly, closure element 28 includes a male closure element 60 and a female closure element 62. Male closure element 60 comprises a base portion 64, a stem portion 66 and engaging portion 68, which is a three-lobed arrowhead having lateral portions or hooks 70 and 72.

The female closure element 62 comprises a base portion 74 and spaced legs 76 and 78 having hooked end portions 80 and 82. Female element 62 is generally C shaped and symmetrical about a longitudinal centerline 88. As can be seen the female closure element 62 is the same as female closure element 32 but positioned on the opposing wall 14. In addition to single zipper configurations, female closure elements 32 and 62 and male closure elements 30 and 60 may be any combination of hooks, arrows, variations as noted above and otherwise configured and arranged on the walls 12 and 14.

The Deformed Segments

Referring now to FIG. 3, an enlarged, fragmentary, sectional view taken generally along lines 3-3 of FIG. 1 through a deformed segment 92 is shown. As can be seen, in the deformed segments 92, the male closure elements 30 and 60 still engage the female closure elements 32 and 62. Although the female closure elements 32 and 62 are unchanged, the male closure elements 30 and 60 have been asymmetrically deformed. In brief overview, in a preferred embodiment, the sealing surface or stem portion 36 on one side has remained intact whereas the sealing surface/stem portion 36 has been modified on the opposing side.

In the deformed segments 92 of the first closure mechanism 26, the engaging portion 38 and the stem 36 of the male closure element 30 have been reshaped but the base has remained substantially unchanged. The deformation of the stem 36 is more pronounced on the bag side than the relatively minor amount of deformation, if any, on the lip side such that the sealing surfaces remain intact on the lip side. However on the bag side, the stem 36 has been deformed or notched. The hook 40 is no longer pronounced and a width W of the engaging portion 38 (seen in FIG. 7A discussed below) is approximately equal to the width of the stem 36. The bag side of the male closure element 30 is notched inward from just above the base 34 to the engaging portion 38. As a result, the sealing surface of the stem 36 has been impacted and a gap 39 may exist on the bag side between the male closure element 30 and female closure element 32. In another embodiment, the stem portion 36 remains substantially unchanged so that the sealing surfaces are maintained intact on both sides of the male closure element.

By maintaining the stem 36 on the lip side relatively unchanged, the leg 50 still effectively seals onto the lip side of the stem 36 of the male closure element 30. The contact between the leg 52 and the bag side of the stem 36 may also seal but due to the deformation, the seal may be ineffective or perform to a lesser degree than desired. Although there may not be an effective seal on the bag side, the first closure mechanism 26 maintains the seal by virtue of the sealing surfaces engaging normally on the lip side. In an alternative embodiment, the hook 40 points to the lip side and the hook 40 is still relatively more deformed and vice versa. It is also envisioned that only one of the closure mechanisms 26 and 28 may have deformed portions such that one of the closure mechanisms 26 or 28 maintains intact sealing. In another embodiment, the lip side(s) of the closure elements maintain seal integrity and the bag sides are substantially more deformed.

Still referring to FIG. 3, in the deformed segments 92 of the second closure mechanism 28, the second male closure element 60 has also been asymmetrically deformed. The lateral members 70 and 72 have been reshaped but the base 64 has remained relatively unchanged. On the lip side, the stem portion 66 has remained relatively unchanged or only subject to minor deformation but on the bag side, the stem portion 66 has been deformed. As seen in FIG. 7B and discussed below, the width W of the engaging portion 68 is substantially the same as the width of the stem portion 66. Preferably, the engaging portion 68 and stem portion 66 have the same basic shape in the deformed segments 92. By maintaining the stem 66 relatively unchanged, the leg 78 is able to effectively seal thereto on the bag side to provide a second effective seal on the bag side of the second closure mechanism 28. The other leg 76 may also effectively seal against the stem 66 of the male closure element 60 in the deformed segments 92 depending upon the degree of deformation, if any, of the stem 66 on that side.

Preferably, a ratio of the length of the deformed segments 92 to the length of the normal segments 90 is approximately one. Typically, the length of the segments 90 and 92 is less than about 0.175 of an inch {4.44500 mm} so that a plurality of deformed segments 92 are depressed by one's fingers during venting as described hereinbelow. In one embodiment, the length of the segments 90 and 92 is about 0.15 of an inch {3.81 mm}. In alternative embodiments, the normal segments 90 are significantly longer than the deformed segments 92 or vice versa. In another embodiment, the lengths of the segments 90 and 92 vary. By varying the lengths of the segments 90 and 92, different frequency sounds may be created. Hence, the closure mechanisms 26 and 28 may create different audible sounds and tactile cues.

A Process and Apparatus for Making the Double Zipper

Double zippers of the subject technology may be extruded and post-applied or extruded with the pouch as is known in the art. After formation, the male closure elements 30 and 64 are processed through a deforming apparatus to create the deformed segments 92. Deforming apparatus typically use an identical pair of matched deformer rings. For example, see U.S. Pat. No. 5,140,727, issued to Dais et al. on Aug. 25, 1992 and U.S. Pat. No. 5,647,100, issued to Porchia et al. on Jul. 15, 1997. However, the subject technology uses different deformer rings to create different effects on opposing sides of the same profile. Various combinations and configurations may be used such as shown in U.S. patent application Ser. No. 12/916,005 filed Oct. 29, 2010.

Figure 4A:
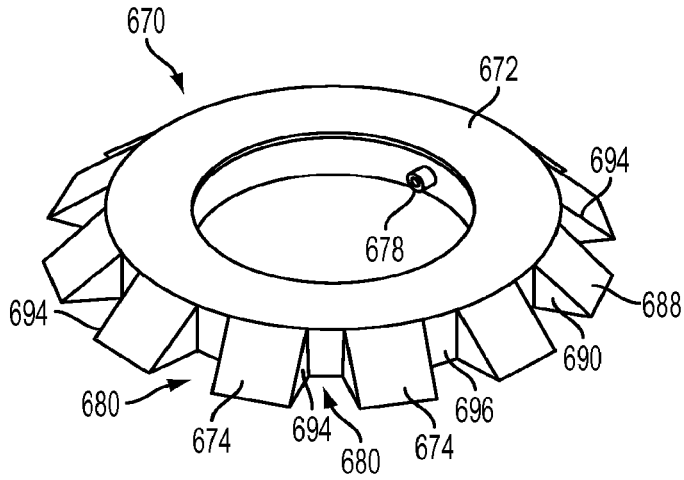
FIG. 4A is perspective view of a toothed gripper wheel or deformer ring for use in a deforming apparatus to manufacture a closure mechanism in accordance with the subject technology.
Figure 4B:
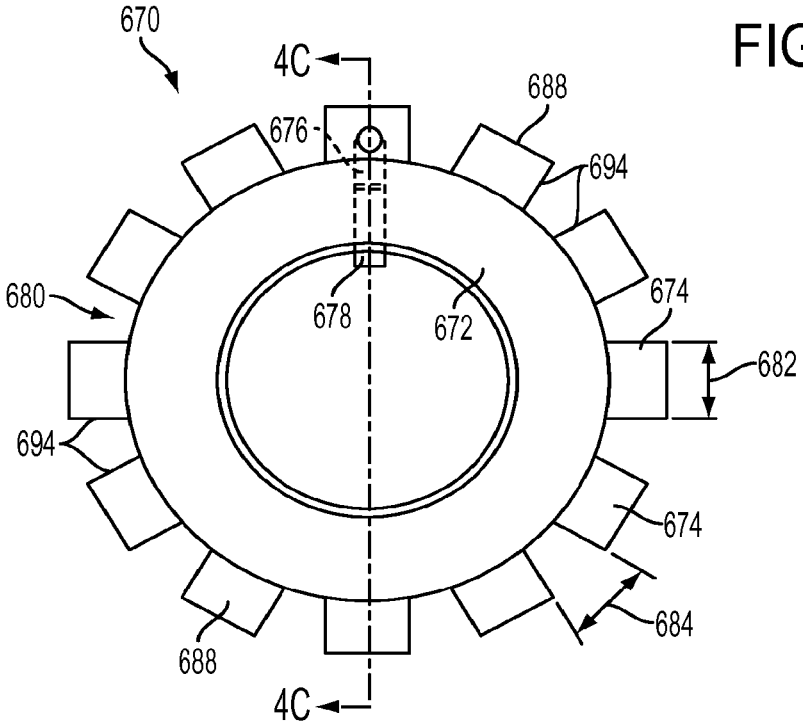
FIG. 4B is top view of the deformer ring of FIG. 4A.
Figure 4C:
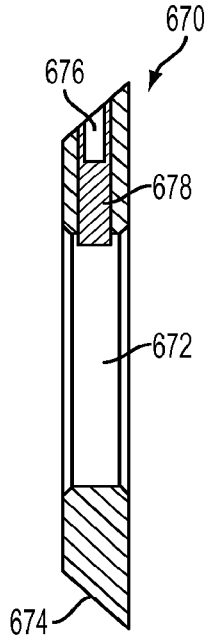
FIG. 4C is cross-sectional view of the deformer ring of FIG. 4A taken along line C-C.

Now referring to FIGS. 4A-C, perspective, top, and cross-sectional views of one deformer ring 670 for use in a deforming apparatus (not shown) in accordance with the subject technology are shown. The deformer ring 670 has an annular body 672 with a plurality of teeth 674 formed on an outer circumference thereof. The teeth 674 have an angled surface 688 that applies pressure to deform the male closure element. The angled surfaces 688 also form cutting edges 694 that notch the male closure element. Intermediate the angled surfaces 688 are sidewalls 690 and inner walls 696 that do not engage the profile being worked.

A throughbore 676 is formed in the annular body 672 to receive a dowel 678, which facilitates mounting the deformer ring 670 to the deforming apparatus. The teeth 674 are separated by gaps 680, which create a tooth arc length 682 and gap arc length 684 on the outermost portion of the deformer ring 670. In use, the tooth are length 682 and the gap arc length 684 form the normal and deformed segments 90 and 92, respectively, in the male closure elements.

In one embodiment, the tooth arc length 682 and the gap arc length 684 are approximately equal but either may be longer than the other. Preferably, the tooth arc length 682 and the gap arc length 684 are about 0.15 of an inch {3.81 mm} or less. In another embodiment, the gap arc length 682 is less than about 0.175 of an inch {4.44500 mm} and the tooth arc length 684 is about 0.148 of an inch {3.75920 mm}. In another embodiment, multiple toothed deformer wheels 670 are available of different tooth arc and gap arc lengths 682 and 684. In one embodiment, a ratio of the tooth arc lengths between the different deformer wheels 670 is selected from the group of ratios of approximately 1.5, 2, 3 and 4. In still another embodiment, the tooth are length 682 and the gap arc length 684 are irregular or vary according to a pattern.

Figure 5A:
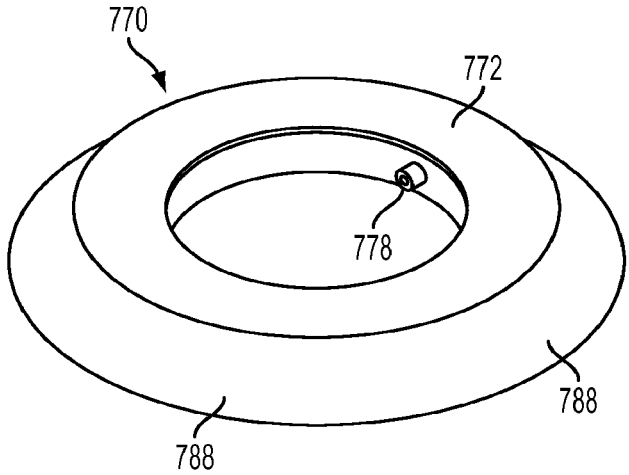
FIG. 5A is perspective view of a smooth gripper wheel or deformer ring for use in a deforming apparatus to manufacture a closure mechanism in accordance with the subject technology.
Figure 5B:
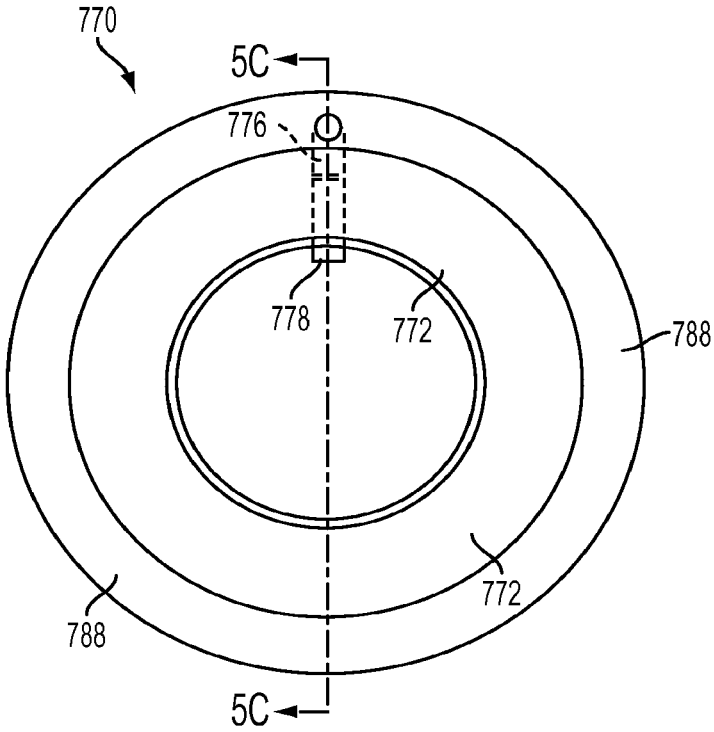
FIG. 5B is top view of the deformer ring of FIG. 5A.
Figure 5C:
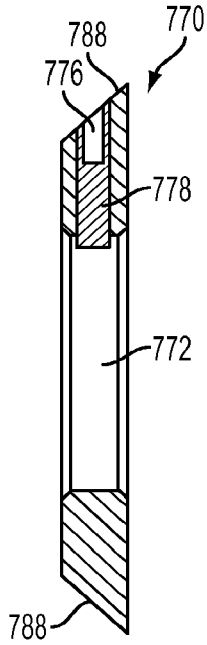
FIG. 5C is cross-sectional view of the deformer ring of FIG. 5A taken along line C-C.

Now referring to FIGS. 5A-C, perspective, top, and cross-sectional views of another deformer ring 770 for use in a deforming apparatus (not shown) with the deformer ring 670 in accordance with the subject technology are shown.

As will be appreciated by those of ordinary skill in the pertinent art, the deformer ring 770 is structurally similar to the deformer ring 670 described above. Accordingly, like reference numerals preceded by the numeral "7" instead of the numeral "6", are used to indicate like elements. The primary difference of deformer ring 770 in comparison to the deformer ring 670 is the that the deformer ring 770 has an annular body 772 with a uniform angled surface 788 formed on an outer circumference thereof. The angled surface 788 also applies pressure to deform the male closure element but without teeth. As a result, the deformer ring 770 has an attenuated effect as shown in FIGS. 7A and 7B discussed below.

The deformer rings 670, 770 and technology related to the same may also be implemented in any deforming apparatus now known and later developed. One apparatus or process for making a male closure element for a reclosable thermoplastic bag in accordance with the subject technology would include an extruder for providing a longitudinally extending profile of a substantially uniform shape as shown in the normal segments 90 above.

Figure 6:
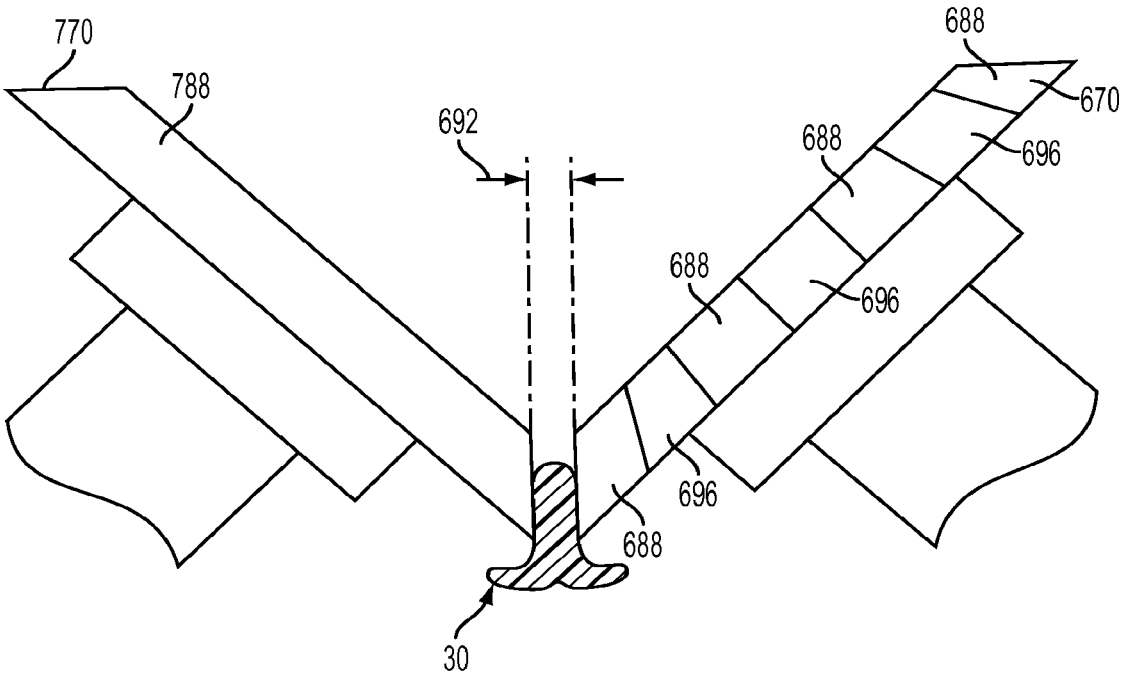
FIG. 6 illustrates the toothed gripper wheel and the smooth gripper wheel of FIGS. 4A and 5A in forming a male element of the closure mechanism of the present technology.

As shown in FIG. 6, the deforming apparatus includes the deformer rings 670 and 770 arranged in opposition to work the male closure elements 30 and 60. The angled surfaces 688 and 788 of the deforming rings 670 and 770 are set parallel and apart a gap 692 approximately equal to a cross-sectional width of the stem 36 plus or minus about 0.001 or 0.002 of an inch {0.0254 to 0.0508 mm}. Thus, as the male closure element 30 passes through the gap 692 at any linespeed, force from the deformer rings 670 and 770 creates compression and deformation of the male closure element 30. The engaging portion 38 is deformed into the male closure element 30. The second male closure element 60 is deformed by a similar operation. In one embodiment as shown, the teeth 674 create cuts or notches in the stem portion 36 of about 0.002 inches {0.0508 mm}. In another embodiment, the stem portion 36 is relatively unchanged.

Figure 7A:
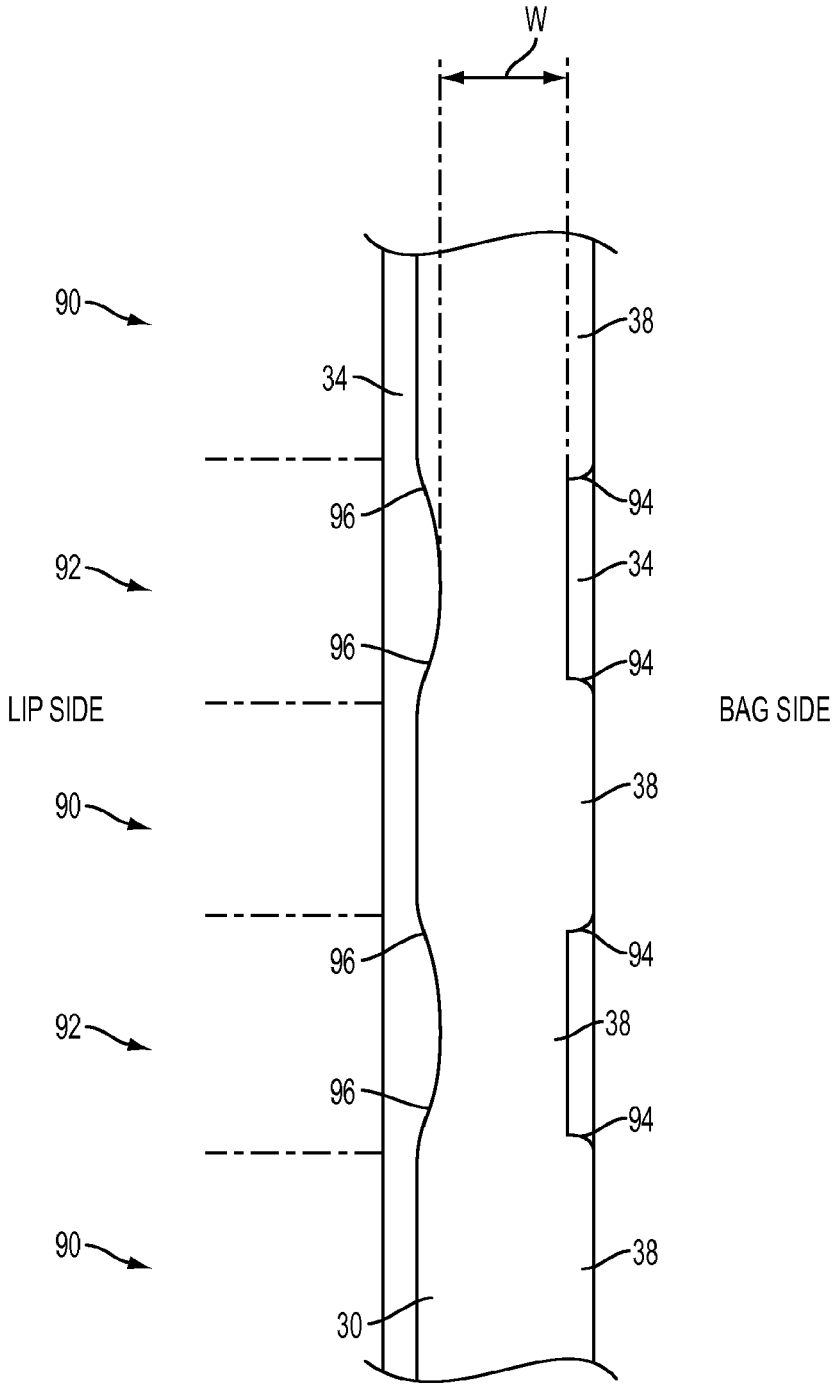
FIG. 7A is a top view of an exemplary male closure element having a normal asymmetric hook type configuration after having been deformed by the toothed smooth gripper wheels in accordance with the subject technology.
Figure 7B:
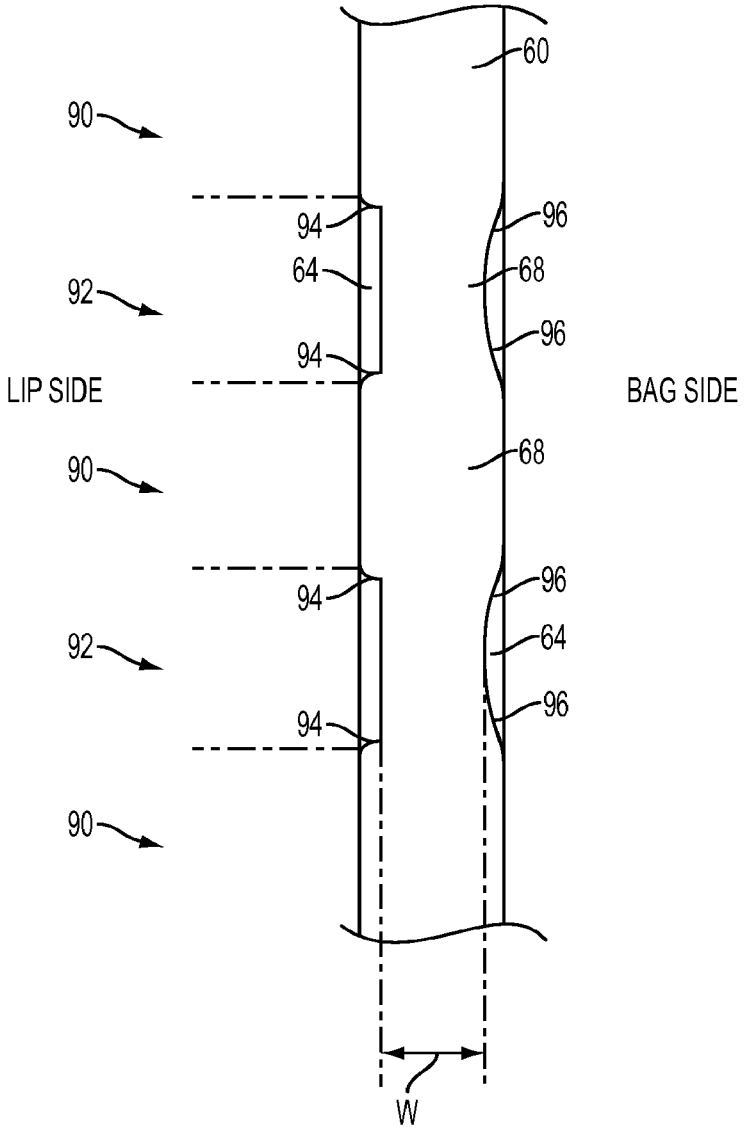
FIG. 7B is a top view of an exemplary male closure element having a normal symmetric arrow head type configuration after having been deformed by the toothed smooth gripper wheels in accordance with the subject technology.

Referring now to FIGS. 7A and 7B, top views of exemplary male closure elements 30 and 60 having arrow head and hook type configurations are shown. The male closure elements 30 and 60 have been deformed by opposing toothed and smooth gripper wheels 760 and 770. FIGS. 7A and 7B are somewhat schematic to illustrate concepts and varying configurations could result depending upon processing parameters and ring configuration as would be appreciated by those of ordinary skill in the pertinent art.

In the normal segments 90 of the male closure elements 30 and 60, the male closure elements 30 and 60 are unchanged despite having passed through the gap 692. The normal segments 90 are created by passing between the deformer ring 670 corresponding to the gaps 680 such that only the angled surface 788 of the opposing smooth deformer ring 770 makes contact with the male closure elements 30 and 60. The male closure elements 30 and 60 simply deflect from contact by only the single deformer ring 770 and remain unchanged.

However, as the cutting edges 694 and angled surfaces 688 contact the male closure elements 30 and 60, compression and deformation of the male closure elements 30 and 60 occurs, which is particular distinct on the side of the toothed deformer ring 670. On the toothed deformer wheel side (e.g., shown as the right side in FIG. 7A and the left side in FIG. 7B), the cutting edges 694 create fairly crisp steps or notches as transitions 94 between the normal and deformed segments 90 and 92. However, on the side of the smooth deformer wheel 770 (e.g., the left side in FIG. 7A and the right side in FIG. 7B), gradual ramps 96 as transitions occur while the stems 36 and 66 remain substantially unchanged.

Without being limited to any particular theory, during opening and closing of the double zipper in accordance with the subject technology, the female legs 50, 52, 76 and 78 snap into and out of the deformed segments 92 along the notch transitions 94 to create an audible sound as well as tactile clicking. The notch transitions 94 are structurally modified such that the seal integrity between the stem 36 and 66 and female legs 50, 52, 76 and 78 is maintained but weakened. However, on the smooth deformer wheel side, the female legs 50, 52, 76 and 78 slide across the ramps 96 in a relatively smoother and quieter manner if not substantially click-free while fully maintaining the seal integrity in either case. Thus, by having a combination of notch transitions 94 and ramps 96 on opposing sides, closure mechanisms can produce desirable clicking sounds and/or clicking tactile responses on one side while maintaining excellent seal integrity on the other side. Depending upon various fabrication techniques, the transitions between the segments 90 and 92 may vary to certain degrees. It is envisioned that the clicking sound and/or feel will be substantially generated on one side whereas the other side will remain relatively smooth and, therefore, quiet so that effective sealing is guaranteed. In one embodiment, at least a portion of the notch transitions 94 has an angular wall change of at least 75 degrees from the longitudinal axis of the elongated male closure element. In contrast, the ramps 96 have an angular wall change of no more than 45 degrees. In another embodiment, the angular wall change of the notch transitions 94 is from about 80 to 90 degrees and the ramps 96 is from about 25 to 35 degrees. In a preferred embodiment, the notch transitions 94 are approximately 90 degrees and the ramps 96 are less than about 30 degrees.

In an alternative embodiment, each side produces a clicking sound and/or clicking tactile response but to varying degrees due to the difference in deformation. The female profiles may also be deformed, just the female profiles, just a pair of a female and male profile, or even a single profile is deformed and the like depending upon the desire effect. For another embodiment, different deformer wheels are utilized to produce clicking sounds of varying frequencies from varying sides of the profiles. As can be seen, three types of closure mechanisms can be used in any combination. For example, on a double zipper one could use any of: a traditional sealing structure without any deformed segments; a clicking structure in accordance with the '298 and '727 patents; and clicks substantially from one side as disclosed herein. Hence, for a double zipper, nine different combinations are possible to yield various combinations of sealing and clicking structures as desired. Further, separation between the closure mechanisms may be such that a double zipper could be used where the user may only selectively engage one of the zippers. Additionally, venting closure mechanisms and methods as disclosed in U.S. patent application Ser. No. 13/031,843 filed on Feb. 22, 2011 may be utilized.

The present technology is useful in storage bags and provides an improved closure mechanism. The present technology provides a closure mechanism having an improved substantially leak-proof seal utilizing asymmetric deformations on portions thereof to create a clicking sound and/or feel upon opening and closing of the bag. Male profiles that terminate in arrow head and hook configurations as well as other forms may be utilized in any combination. For example, hook portions may be employed so that the closure mechanism has a closing force varies depending upon direction and/or between each element of a double zipper. The subject technology may also be applied to single zipper closure mechanisms or just one or two parts of a double zipper closure mechanism. In one embodiment, the closing force of the closure mechanisms is in a range of about 0.20 lb. to about 0.30 lb. In another embodiment, the hook portions extend in opposite directions outward from the closure mechanism and in another, the hook portions extend in the same direction towards the bag or the lip side.

INCORPORATION BY REFERENCE

All patents, patent applications and other references disclosed herein are hereby expressly incorporated in their entireties by reference.

The exemplary embodiments herein disclosed are not intended to be exhaustive or to unnecessarily limit the scope of the technology. The exemplary embodiments were chosen and described in order to explain the principles of the present technology so that others skilled in the art may practice the present technology. As will be apparent to one skilled in the art, various modifications can be made within the scope of the aforesaid description. Such modifications being within the ability of one skilled in the art form a part of the present technology and are embraced by the appended claims.

What is claimed is:

1. A reclosable pouch comprising:

a body portion having first and second bag walls; and an elongated closure mechanism defining a longitudinal axis and including: an elongated male closure element having a base, a stem and an engagement end; and a female closure element, wherein the female closure element has first and second spaced legs, wherein the male and female closure elements are disposed on opposing sides of the first and second bag walls, and the male closure element is constructed and arranged to engage the legs of the female closure element such that at least one of the male and female elements includes intermittent deformations on a first side and a second side with gradual transitions to the intermittent deformations all along the first side and steep transitions to the intermittent deformations all along the second side, the intermittent deformations being asymmetric about the longitudinal axis and creating at least one of a clicking feel and a clicking sound when the pouch is closed.

2. The reclosable pouch of claim 1, wherein the deformations are formed by a first toothed gripper wheel and a second smooth gripper wheel being deployed in an opposing manner to form a gap.

3. The reclosable pouch of claim 2, wherein said first toothed gripper wheel and said second smooth gripper wheel are at approximately 45° angles and the gap between said wheels is constructed and arranged to receive said male closure element to provide deformation therein, wherein said gap is of a distance less than a width of the stem so that the stem is deformed substantially only on a side of the stem acted upon by the first toothed gripper wheel.

4. The reclosable pouch of claim 1, wherein the pouch includes a second closure mechanism.

5. The reclosable pouch of claim 1, wherein closure creates the clicking sound and feel.

6. The reclosable pouch of claim 1, wherein only the male element is deformed and the stem of the male element is substantially unchanged on an opposing side to the deformations to maintain an effective seal.

7. A reclosable pouch comprising:

opposing first and second walls joined together to form an interior for storing items;

an elongated male closure element coupled to the first wall having a proximal base adjacent the first wall, a stem extending from the base, and a distal end, wherein the male closure element defines a plurality of deformed segments intermittent normal segments along a length thereof with transitions between the deformed segments and the normal segments, the transitions all being steep on a first side of the elongated male closure element and the transitions all being gradual on an opposing second side of the elongated male closure element; and an elongated female closure element coupled to the second wall, and the female closure element has first and second spaced legs that define a channel, wherein when the male closure element interlocks in the channel of the female closure element, the pouch is sealed and a clicking sound is generated substantially by interaction between the female closure element and the steep transitions of the first side.

8. A reclosable pouch as recited in claim 7, wherein the steep transitions of the first side have an angular wall change of at least 75 degrees from a longitudinal axis of the elongated male closure element and the gradual transitions of the second side have an angular wall change of no more than 45 degrees.

9. A reclosable pouch as recited in claim 8, wherein the steep transitions have an angular wall change from about 80 to 90 degrees and the gradual transitions have an angular wall change from about 25 to 35 degrees.

10. A reclosable pouch as recited in claim 8, wherein the steep transitions have an angular wall change of approximately 90 degrees and the gradual transitions have an angular wall change of less than about 30 degrees.

11. A reclosable pouch as recited in claim 7, further comprising a second male closure element and a second female closure element coupled to the walls, the male closure element being sized and arranged to interlock in the female closure element such that a clicking sound is generated.

12. A reclosable pouch as recited in claim 11, wherein the second male closure element generates the clicking sound at an audibly different frequency from the first male closure element by having deformed segments of a different length than the deformed segments of the first male closure element.

13. A reclosable pouch comprising:

first and second opposing walls joined to form a bag, each wall having a lip that forms part of an opening for the bag; and an elongated closure mechanism attached to the walls for sealing the opening and defining a longitudinal axis, the closure mechanism having: at least one female closure element; and at least one male closure element having a plurality of deformed portions intermittent normal portions, wherein on a first side of the male closure element, sealing surfaces are substantially unchanged from the normal to the deformed portions and gradual ramps define all transitions between the normal and deformed portions, on a second side of the male closure element, transitions from the normal to the deformed portions are all defined by substantial steps so that the at least one male closure element is asymmetrical about the longitudinal axis, and upon inserting the male closure element into the female closure element, the substantial steps create one of a clicking feel or a clicking sound.

14. A reclosable pouch as recited in claim 13, wherein a length of the deformed portions is less than 0.15 of an inch {3.81 mm}, wherein the female closure element also defines deformed portions intermittent normal portions.

15. A reclosable pouch as recited in claim 13, wherein the male closure element includes a base and a stem extending from the base to terminate in an engagement feature, wherein the sealing surfaces are substantially on the stem and the engagement feature has a cross-sectional shape selected from the group consisting of a hook, an arrow head, a three-lobed arrow head, a rounded stem, an asymmetrical triangle, and a symmetrical triangle.

16. A reclosable pouch as recited in claim 13, wherein in the deformed portions are formed by a first toothed gripper wheel and a second smooth gripper wheel being deployed in an opposing manner to form a gap through which the male closure element is passed.

17. A reclosable pouch as recited in claim 13, wherein the step transitions have an angular wall change of at least 75 degrees from a longitudinal axis of the male closure element and the gradual ramps have an angular wall change of no more than 45 degrees.

18. A reclosable pouch as recited in claim 17, wherein the step transitions have an angular wall change from about 80 to 90 degrees and the gradual ramps have an angular wall change from about 25 to 35 degrees.

19. A reclosable pouch as recited in claim 17, wherein the step transitions have an angular wall change of approximately 90 degrees and the gradual ramps have an angular wall change of less than about 30 degrees.

20. A reclosable pouch comprising:

a body portion having first and second bag walls; and a closure mechanism including: an elongated male closure element having a base, a stem and an engagement end; and a female closure element, wherein the female closure element has first and second spaced legs, wherein the male and female closure elements are disposed on opposing sides of the first and second bag walls, and the male closure element is constructed and arranged to engage the legs of the female closure element such that at least one of the male and female elements includes intermittent deformations along at least one side, the intermittent deformations being asymmetric and creating at least one of a clicking feel and a clicking sound when the pouch is closed, the deformations are formed by a first toothed gripper wheel and a second smooth gripper wheel being deployed in an opposing manner to form a gap, and said first toothed gripper wheel and said second smooth gripper wheel are at approximately 45° angles and the gap between said wheels is constructed and arranged to receive said male closure element to provide deformation therein, wherein said gap is of a distance less than a width of the stem so that the stem is deformed substantially only on a side of the stem acted upon by the first toothed gripper wheel.

21. A reclosable pouch comprising:

opposing first and second walls joined together to form an interior for storing items;

a first elongated male closure element coupled to the first wall having a proximal base adjacent the first wall, a stem extending from the base, and a distal end, wherein the first male closure element defines a plurality of deformed segments intermittent normal segments along a length thereof with transitions between the deformed segments and the normal segments;

a first elongated female closure element coupled to the second wall having first and second spaced legs that define a channel, wherein when the first male closure element interlocks in the channel of the first female closure element, the pouch is sealed and a first sound is generated substantially by interaction between the first female closure element and the transitions;

a second male closure element coupled to the first wall having a proximal base adjacent the first wall, a stem extending from the base, and a distal end, wherein the second male closure element defines a plurality of deformed segments intermittent normal segments along a length thereof with transitions between the deformed segments and the normal segments; and a second female closure element coupled to the second wall having first and second spaced legs that define a channel, wherein when the second male closure element interlocks in the channel of the second female closure element, the second male closure element generates a second sound at an audibly different frequency from the first male closure element by having deformed segments of a different length than the deformed segments of the first male closure element.

* * * * *